United States Patent [19]

Park

[11] 3,963,628

[45] June 15, 1976

[54] FIBER LUBRICANT COMPOSITION

[75] Inventor: Kisoon Park, Charleston, W. Va.

[73] Assignee: Union Carbide Corporation, New York, N.Y.

[22] Filed: June 7, 1974

[21] Appl. No.: 477,416

[52] U.S. Cl. ..... 252/8.8; 8/93; 252/8.9

[51] Int. Cl.[2] ..... D06M 13/18

[58] Field of Search ..... 8/93; 260/950, 951; 252/8.9, 8.8

[56] References Cited

UNITED STATES PATENTS

| | | | |
|---|---|---|---|
| 2,310,074 | 2/1943 | Götte | 8/93 |
| 3,004,057 | 10/1961 | Nunn | 260/950 X |
| 3,033,889 | 5/1962 | Chiddix et al. | 260/950 X |
| 3,306,850 | 2/1967 | Olsen | 252/8.9 X |
| 3,338,830 | 8/1967 | Stokes et al. | 252/8.9 |
| 3,346,670 | 10/1967 | Papalos | 260/950 X |
| 3,462,520 | 8/1969 | Nehmsmann et al. | 260/950 |
| 3,666,843 | 5/1972 | Fearing | 260/951 |
| 3,770,855 | 11/1973 | Benson et al. | 260/951 X |
| 3,855,776 | 12/1974 | Omura et al. | 252/8.9 X |

*Primary Examiner*—Carman J. Seccuro
*Attorney, Agent, or Firm*—Francis M. Fazio

[57] ABSTRACT

Emulsifiable textile lubricant compositions containing a mineral oil, copoly(oxyethylene-oxypropylene) monoalkyl ether, an organic phosphate and, if desired, an alkanol amine are produced that can be used to prepare stable textile lubricant aqueous emulsions.

10 Claims, No Drawings

FIBER LUBRICANT COMPOSITION

BACKGROUND OF THE INVENTION

In the manufacture and processing of synthetic textile fibers, the fibers move at high speeds and require lubrication to reduce the frictional force; as a consequence many materials have become known that are useful in this regard. However, a problem associated with most of the known fiber lubricants is their tendency to extract dye from dyed yarns or fabrics and their tendency to cause dye bleeding or crocking of the dyestuff while the lubricant is still on the yarn. Extraction or bleeding are undesirable because of the deleterious effects on the final shade. Another problem associated with many fiber lubricants is its removal from the surface of the yarn after it has served its intended function. A good lubricant should be readily removed under mild scouring conditions. In addition, a good textile lubricating composition should be stable in aqueous emulsion for extended periods.

SUMMARY OF THE INVENTION

Emulsifiable textile lubricant compositions containing mineral oil, copoly(oxyethylene-oxypropylene) alkyl mono ether, an organic phosphate and optionally, an alkanol amine have been produced. These compositions can be used to produce aqueous textile lubricant emulsions that are stable and have improved physical and chemical properties. The textile lubricants can be readily tinted with fugitive tinting materials and it was found that the tint could be readily removed from the fiber or fabric by conventional water scouring. It was also found that these textile lubricants had improved dye transfer and dye bleeding properties and could be readily removed from the fabric surface.

DESCRIPTION OF THE INVENTION

In the manufacture of synthetic textile fibers and fabrics it is necessary to lubricate the yarn to prevent breakage and to accelerate production. Many materials have been suggested for this use. However, major problems associated with them have included the extraction of the dyestuff from the yarn by the lubricant, resulting in changes in the shade of the dyed yarn and even the transfer of the dye on to undyed or differently colored yarn or fabric. It has now been found that a textile lubricant composition can be prepared which does not have many of the defects present in previously available compositions.

Ordinarily, the textile lubricants are added to the surface of the yarn or fabric from an aqueous emulsion. It is important that this emulsion not separate or cream on standing to assure an even distribution of the lubricant on the surface. It is also important that one be able to remove the lubricant from the surface after it has served its purpose. In addition, the lubricant should not have any appreciable deleterious effect upon the dyes used to color the yarn or fabric.

As previously indicated, the textile lubricants of this invention are mixtures of several components. In the normal fashion, one prepares an emulsifiable textile lubricant composition and this is converted to the emulsion form at the time it is ready to be used. In this manner, one can dilute the lubricant with water when it is needed and it is not necessary to transfer or ship large quantities of water.

In preparing the emulsifiable textile lubricant composition, any commercially available mineral oil known to those skilled in this art can be used that has a viscosity of from 60 to 250 SUS at 100°F. The preferred mineral oils are those that are colorless and have a viscosity up to 140 SUS at 100°F., with the most preferred having a viscosity of from 70 to 110 SUS at 100°F. The mineral oil is present in the emulsifiable textile lubricant composition at a concentration of from 40 to 80 weight percent, preferably, from 50 to 70 weight percent.

The copoly(oxyethylene-oxypropylene) alkyl mono ethers suitable for use in preparing the emulsifiable textile lubricant compositions are those having the formula:

$$RO(CH_2CH_2O)_x(\underset{\underset{CH_3}{|}}{C}HCH_2O)_yH$$

These materials are well known to those skilled in the art and many of them are commercially available, as described in U.S. Pat. Nos. 2,425,845 and 2,425,755. In the formula, R is an alkyl group of from 8 to 18 carbon atoms such as, octyl, nonyl, decyl, undecyl, dodecyl, stearyl, and the like; the sum of $x + y$ is from 5 to 9, preferably from 6 to 8, with $x$ constituting from 25 to 75 weight percent of said sum, preferably from 40 to 60 weight percent. It was found that compounds in which the sum of $x + y$ is higher produce lubricant compositions that are dye bleed resistant; however, the emulsions are not as stable. The concentration of this copoly(oxyethylene-oxypropylene) alkyl mono ether in the composition can range from 10 to 50 weight percent, preferably from 20 to 40 weight percent.

The organic phosphate present in the emulsifiable textile lubricant composition is of the structural formula:

$$[R'O(CH_2CH_2O)_n]_m\overset{\overset{O}{\|}}{P}(OH)_{3-m}$$

Wherein R′ is alkyl of from 8 to 18 carbon atoms, preferably from 11 to 15 carbon atoms; or alkaryl or aralkyl of from 12 to 18 carbon atoms, preferably from 16 to 18 carbon atoms, with the alkyl group thereof containing from 6 to 12 carbon atoms; $n$ has a value of 3 to 25, preferably from 3 to 10 and $m$ has a value of 1 to 3. The organic phosphate is present in the emulsifiable textile lubricant composition at a concentration of from 1 to 20 weight percent, preferably from 1 to 10 weight percent. The organic phosphates are generally available as mixtures of the mono, di and tri-esters, i.e., mixtures wherein $m$ is 1, 2 and 3. Thus, one can use the individual specific organic phosphates or the mixtures thereof. Illustrative of suitable compounds are those wherein R′ and $n$ in the formula are those groups set forth below, wherein a mixture of the $m$ species is present:

| R′ | n (av.) |
|---|---|
| octylphenyl | 3, 6, 8, or 10 |
| octylnapthyl | 5, 9, or 10 |
| stearylphenyl | 4, 7 or 13 |
| hexylphenyl | 8 or 12 |
| dodecylphenyl | 5, 7, 14 or 21 |
| nonylphenyl | 6, 18 or 25 |
| phenethyl | 3 or 20 |
| 2-ethylhexylphenyl | 5, 9 or 16 |
| 2-ethylhexyl | 3, 8 or 14 |

-continued

| R' | n (av.) |
|---|---|
| nonyl | 6, 10 or 21 |
| octyl | 9, 14 or 18 |
| undecyl | 5, 8 or 19 |
| dodecyl | 8, 13 or 16 |
| stearyl | 4, 8 or 15 |

The emulsifiable textile lubricant composition could also contain from 0 to 10 weight percent, preferably from 0.2 to 5 weight percent of an alkanolamine having a molecular weight of from 120 to 240. Illustrative thereof, one can mention diisopropylamine, triisopropylamine, N,N'-diisopropyl ethanolamine, N-ethyl diethanolamine, and the like.

In some instances, it is desirable to have a fugitive tint in the emulsifiable textile lubricant composition. The amount thereof will vary upon the wishes and desires of the skilled individual and has no effect upon the emulsifiability of the textile lubricant composition.

In an embodiment, emulsifiable textile lubricant composition is prepared by mixing one, or more of each, of the copoly(oxyethylene-oxypropylene) alkyl mono ether, organic phosphate, alkanolamine and tint and then adding this mixture to the mineral oil. The mixing can be done by any conventional means and the temperature for mixing is not critical.

The above emulsifiable textile lubricant composition is readily convertible to an emulsion by addition thereof to water and stirring at room temperature. In preparing the aqueous textile emulsion lubricant, from about 5 to 30, preferably 10 to 20, weight percent thereof is the composition previously described and the balance is water. The emulsion can contain minor amounts of other additives normally present in the textile lubricant emulsions. These are well known to those skilled in the art and need no further discussion or elaboration herein.

The lubricant composition of this invention can be applied to the fiber or yarn or fabric by any conventional means. The procedures therefore are well known to those skilled in the art, as are the different types of equipment that can be used. Generally, the lubricant is applied as an emulsion to facilitate handling and application, though it can be applied neat.

The textile lubricant emulsions of this invention are unexceptedly stable on storage or standing and showed no signs of creaming and separation after standing for many days at room temperature. This was a surprising and unexpected finding since many of the commercially available textile lubricants produce emulsions of poor stability that separate, in some cases, within 30 minutes, or, if they do not separate, they cream.

When using a tinted textile lubricant emulsion, it is important that the tint be removed from the fiber or fabric with ease and that it not stain or affect the yarn or fabric. It was found that the compositions of this invention can be readily removed and that in those instances in which the lubricant compositions were tinted they also could be readily removed by scouring with cold water; whereas many of the commercially available textile lubricants did not behave in this manner.

A critical property desired in a textile lubricant is that it not facilitate the transfer of the dye from the yarn or fabric. In addition, it is important that the textile lubricant does not cause the dye to bleed and thus stain other fabrics or articles with which the colored material may come into contact. The textile lubricants of this invention minimize dye transfer or extraction and are less prone to cause dye bleeding.

The following examples further serve to illustrate the invention. Parts are by weight unless otherwise indicated.

EXAMPLE 1

A stable emulsifiable textile lubricant composition was prepared by mixing 60 parts of white mineral oil having a viscosity of 80 to 90 SUS at 100°F., 20 parts of copoly(oxyethylene-oxypropylene) monododecyl ether having an average of 3.7 oxyethylene groups and 2.8 oxypropylene groups and 20 parts of the mixed phosphate esters of polyoxyethylenated $C_{12}$ to $C_{18}$ alkanols (Gafac RD-510) at 22°C. A portion of 20 parts of this composition was added to 80 parts of water to produce a stable textile lubricant emulsion; it showed no signs of creaming or separation after standing at ambient room temperature for more than 40 days. It had a pH of about 2.5. In comparison, nine commercial lubricant compositions formed emulsions that either creamed or separated. The commercial lubricant compositions available varied and contained from 70 to 95 weight percent mineral oil and from 5 to 15 weight percent of nonionic emulsifiers having a $C_{11}$ to $C_{15}$ hydrophobe and about 3 to 5 ethyleneoxy units per molecule. The results are tabulated below:

| EXAMPLE 1 | 40 Days | No Cream or Separation |
|---|---|---|
| Emulsion Controls | Creaming Time | Complete Separation |
| A | 6 Hours | 11 Days |
| B | — | 30 Min. |
| C | — | 30 Min. |
| D | 12 Days | 15 Days |
| E | 30 Min. | 3 Days |
| F | 30 Min. | 2 Days |
| G | 30 Days | 40 Days |
| H | 2 Hours | — |
| I | 11 Days | 10 Days |

When the copoly(oxyethylene — oxypropylene) monododecyl ether was replaced by equal amounts of different homopolymers of the type poly(oxyethylene mono- $C_{11}$ to $C_{15}$ ethers containing 3 to 12 ethyleneoxy units, the resulting compositions would not form aqueous emulsions when mixed with water.

EXAMPLE 2

A stable emulsifiable textile lubricant composition was produced containing 50 weight percent white mineral oil having a viscosity of about 80 SUS at 100°F., 40 weight percent of the same copoly(oxyethylene — oxypropylene) monododecyl ether used in Example 1 and 10 weight percent of the same organic phosphate used in Example 1 at 22°C. An aqueous textile lubricant microemulsion was prepared containing 20 weight percent of the above lubricant composition; it had a pH of 2.5 to 3.0. The microemulsion was produced by adding the lubricant composition to the water and stirring at 22°C. for several minutes. This microemulsion showed no signs of creaming or separation on standing at room temperature for more than four months. At the end of this period it was still useful as a textile lubricant. Further, incremental additions of diisopropanolamine to maintain a pH of 7 did not affect the emulsion stability.

EXAMPLE 3

A stable emulsifiable textile lubricant composition was produced containing 70 weight percent of white mineral oil having a viscosity of 80 to 90 SUS at 100°F., 28.7 weight percent of the same copoly(oxyethylene — oxypropylene) monododecyl ether used in Example 1, 1 weight percent of the mixed phosphate esters of polyoxyethylated $C_8$ to $C_{12}$ alkylphenol (Standafos RA-740), and 0.3 weight percent of diisopropanolamine at 22°C. An aqueous textile lubricant emulsion was prepared containing 20 weight percent of the above composition to water and stirring at 22°C. for 15 minutes. This aqueous emulsion showed no indication of creaming or separation on standing for 14 days, after which slight evidence of creaming was noted.

EXAMPLE 4

A tinted stable emulsifiable textile lubricant composition was produced containing 48.5 weight percent white mineral oil having a viscosity of 80 to 90 SUS at 100°F., 38.8 weight percent of the same copoly(oxyethylene — oxypropylene) monododecyl ether used in Example 1, 9.7 weight percent of the same organic phosphate used in Example 1 and 3 weight percent of a fugitive soluble red acid dye. (COLOUR INDEX NO. 18050) An aqueous textile lubricant emulsion was prepared containing 20 weight percent of the above composition. This aqueous lubricant emulsion was applied to a white textured polyester knit fabric at a loading level of about 5 to 6 percent by fabric weight and then given a cold tap water scour to evaluate for removal of dye. A clean, white fabric, free of any tint was obtained.

For comparative purposes, a commercially available tinted lubricant (Seccolube 1A-M Red), based on mineral oil and a nonionic surfactant, was applied to the same white polyester knit fabric in the same manner. The cold tap water scour did not remove the dye and a substantial amount of tint was retained on the fabric. Complete tint removal could not be obtained even with a heated scour bath at 120° to 160°F. containing 0.15 weight percent of a surfactant, the reaction product of 12 moles of ethylene oxide with mixed $C_{11}$ to $C_{15}$ alkanols and 0.15 weight percent of triisodiumpyrophosphate.

This example shows that the compositions of this invention can be tinted with conventional fungitive dyes in the approved manner and can subsequently be readily removed thus not affecting the color of the lubricated polyester fabric.

EXAMPLE 5

Two emulsifiable textile lubricant compositions were produced having the following composition:

| COMPOSITION | I | II |
|---|---|---|
| White mineral oil (90 SUS) | 60 | 60 |
| Copoly(oxyethylene-oxypropylene) monododecyl ether (100 SUS) | 20 | 30 |
| Organic Phosphate of Ex. 1 | 20 | 10 |

In addition to the above, mineral oil, and seven commercially available textile lubricants were evaluated for dye extraction and dye transfer. The results of the tests are set forth below. In the dye extraction test, lower percent transmittance reduction values are preferred; this is indicative of low dye extraction. In the dye transfer test, the results are rated visually from 0, no transfer, to 7, heavy transfer; again, low values are preferred. These tests indicate the suitability of the lubricants in aqueous textile lubricant emulsions and their advantages over presently available textile lubricants.

| Lubricant | Transmittance Reduction, % | Dye Transfer |
|---|---|---|
| Comp. I | 23.8 | 2 |
| Comp. II | 24.6 | 2 |
| Controls | | |
| Mineral Oil | 15.8 | 1 |
| A | 58.2 | 4 |
| B | 58.3 | 4 |
| C | 61.9 | 4 |
| D | 66.6 | 5 |
| E | 68.3 | 6 |
| F | 68.7 | 6 |
| G | 79.0 | 7 |

In the dye extraction test, a 1 gram sample of a commercial blend of a dyeable polyester and polyacrylonitrile fabric dyed with a combination of three dyes, Latyl Blue LS (Disperse Blue 62), Latyl Blue 2R (Disperse Blue 63) and Polydye Bright Orange O (Disperse Blue 59), is immersed in 15 grams of the test lubricant and kept at 50°C. for 3 hours. The liquid is then decanted and centrifuged to remove particulate matter and the light transmittance measured with a Bausch and Lomb visible spectrophotometer at a wavelength of 450 n.m. The percent transmittance reduction, TR, is calculated using the equation:

$$\% TR = \frac{TC - TS}{TC} \times 100$$

where *TC* is the light transmittance of the control and *TS* is the light transmittance of the decanted liquid.

In the dye transfer test, a 3 inch square of the dyed fabric is sprayed with a 2 percent isopropanol solution of the lubricant to give about 8 to 9 percent loading on the weight of the fabric. The treated fabric was dried for about 24 hours at 30 percent relative humidity at 25°C. A clean piece of white polyester knit fabric is placed on the lubricated fiber sample, the two-layer fabric sample is placed between aluminum plates and heated for 72 hours at 160°F. under an eight pound weight. The undyed fabric is separated from the dyed fabric and the degree of dye transfer is visually rated.

EXAMPLE 6

The textile lubricant of 70 parts of white mineral oil (80 SUS), 28.7 parts of the copoly(oxyethylene-oxypropylene) monododecyl ether of Example 1, 1 part of the organic phosphate of Example 1 and 0.3 part of diisopropanolamine was applied neat to a white textured polyester knit fabric to give a loading of 3.4 percent on the weight of the fabric.

In like manner two commercially available textile lubricant compositions were applied to the same fabric to give loadings of 3.0 (Comp. A) and 3.2 (Comp. B) percent for comparative evaluations. The lubricant used in Comp. A contained mineral oil, an ethoxylated $C_{11}$ to $C_{15}$ primary alcohol adduct and a trace of butyl stearate and the lubricant used in Comp. B contained a fatty acid glyceride and an emulsifier.

The lubricated fabrics were scoured in a Launder-O-Meter at 160°F. for 45 minutes using plain tap water at a water-to-fabric ratio of 40:1 and then the amount of lubricant remaining on the fabric was determined by weight retained on the fabric. The results showed that essentially all of the textile lubricant composition of this invention was readily removed from the fabric whereas only minor amounts of the commercially available textile lubricants were removed from the fabric. The results are tabulated below:

| COMPOSITION | EX. 6 | A | B |
|---|---|---|---|
| Initial Lubricant Loading, % | 3.4 | 3.0 | 3.2 |
| Lubricant Loading after Scour, % | 0.3 | 2.66 | 2.66 |
| % Removed | 99.1 | 12.4 | 17.6 |
| % Retained | 0.9 | 87.6 | 82.4 |

EXAMPLE 7

The effect of the lubricants of this invention on yarn lubricity and static protection were determined. The aqueous textile lubricant emulsion of Example 1 was applied at a loading of 3 percent by weight of the yarn on yarn free of any finish. The lubricated yarn was then conditioned for at least 24 hours before frictional properties were determined using an Atlab Friction Tester (Custom Scientific Co.). The yarn-to-yarn friction values were measured at 100 meters per minute and the difference between the pretension, 5 grams, and the final tension recorded as the friction force in grams. The yarn-to-yarn measurements were done at a 720° contact (two full turns). The yarn-to-metal measurements were made on polished chrome pins at a 180° contact. The results are tabulated below:

YARN-TO-YARN FRICTION FORCE

| | | |
|---|---|---|
| Example 6 | LUBRICANT ON POLYESTER | 10 |
| FINISH FREE | POLYESTER | 15 |
| Example 6 | LUBRICANT ON POLYAMIDE | 11 |
| FINISH FREE | POLYAMIDE | 17 |
| Example 6 | LUBRICANT ON POLYPROPYLENE | 10 |
| FINISH FREE | POLYPROPYLENE | 14 |

YARN-TO-METAL FRICTION FORCE

| | | |
|---|---|---|
| Example 6 | LUBRICANT ON POLYESTER | |
| | at 100 meters per minute | 64 |
| | at 200 meters per minute | 84 |

The static charge measurements were made using a Rothschild Voltmeter. The lubricated yarn bundles were conditioned at least 24 hours at 65 percent relative humidity and 75°C. and there was then applied 100 D.C. volts, by means of a potentiometer attached to the voltmeter, on the two ends of the yarn bundle. The time required for the voltmeter needle to move from full to half scale, after removal of the potential, was recorded and reported as the half-life of charge dissipation. The lubricant was applied neat to the yarn. The half-lives are set forth below:

| | | |
|---|---|---|
| Example 6 | Lubricant on Polyester | 140 sec. |
| Finish Free | Polyester | >300 sec. |

-continued

| | | |
|---|---|---|
| Commercial* | Lubricant on Polyester | 270 sec. |

*Blend of mineral oil and a nonionic emulsifier of a $C_{11}$ to $C_{15}$ primary alkanol adduct with an average of 3 ethyleneoxy units, with a trace amount of butyl stearate.

What is claimed is:

1. An emulsifiable textile lubricant composition comprising:

A. from 40 to 80 weight percent of mineral oil having a viscosity of from 60 to 140 SUS at 100°F., B. from 10 to 50 weight percent of a copoly(oxyethylene-oxypropylene) monoether of the formula:

$$RO(CH_2CH_2O)_x(\overset{\overset{\displaystyle CH_3}{|}}{C}HCH_2O)_yH$$

wherein R is alkyl of 8 to 18 carbon atoms, the sum of *x* plus *y* is from 5 to 9 with x constituting from 25 to 75 weight percent of said sum of *x* plus *y*, C. from 1 to 20 weight percent of an organic phosphate of the formula:

$$\left[R'O(CH_2CH_2O)_n\right]_m \overset{\overset{\displaystyle O}{\|}}{P}(OH)_{3-m}$$

wherein R′ is alkyl of from 8 to 18 carbon atoms, or alkaryl or aralkyl of from 12 to 18 carbon atoms in which the alkyl group contains from 6 to 12 carbon atoms, *n* has a value of 3 to 25 and *m* has a value of 1 to 3, and D. from zero to 10 weight percent of an alkanolamine having a molecular weight of 120 to 240.

2. An emulsifiable textile lubricant composition as claimed in claim 1 wherein a tinting dye is additionally present.

3. An emulsifiable textile lubricant composition as claimed in claim 1 wherein R is alkyl of 11 to 15 carbon atoms and *x* constitutes about 50 weight percent of the sum of *x* plus *y*.

4. An emulsifiable textile lubricant composition as claimed in claim 1 wherein R′ is alkyl of 11 to 15 carbon atoms and the total number of *n* groups present in said organic phosphate is less than 12.

5. An emulsifiable textile lubricant composition as claimed in claim 3 wherein R′ is alkyl of 11 to 15 carbon atoms and the total number of *n* groups present in said organic phosphate is less than 12.

6. A textile lubricant emulsion comprising from 5 to 50 weight percent of the emulsifiable textile lubricant composition claimed in claim 1 and from 50 to 95 weight percent of water.

7. A textile lubricant composition as claimed in claim 6 comprising from 5 to 50 weight percent of the emulsifiable textile lubricant composition claimed in claim 2 and from 50 to 95 weight percent of water.

8. A textile lubricant composition as claimed in claim 6 comprising from 5 to 50 weight percent of the emulsifiable textile lubricant composition claimed in claim 3 and from 50 to 95 weight percent of water.

9. A textile lubricant composition as claimed in claim 6 comprising from 5 to 50 weight percent of the emulsifiable textile lubricant composition claimed in claim 4 and from 50 to 95 weight percent of water.

10. A textile lubricant composition as claimed in claim 6 comprising from 5 to 50 weight percent of the emulsifiable textile lubricant composition claimed in claim 5 and from 50 to 95 weight percent of water.

* * * * *